United States Patent [19]

Smith

[11] 3,947,107

[45] Mar. 30, 1976

[54] PARTIALLY SUBMERGED ACTIVE CROSSMIXER

[75] Inventor: Richard E. Smith, Webster, N.Y.

[73] Assignee: Xerox Corporation, Stamford, Conn.

[22] Filed: Nov. 20, 1974

[21] Appl. No.: 525,531

[52] U.S. Cl. ..... 355/3 DD; 118/637; 118/621

[51] Int. Cl.[2] ..... G03G 15/09

[58] Field of Search ..... 355/3 DD, 3 R, 14; 118/637, DIG. 24, 621; 222/DIG. 1; 96/1 SD; 427/18

[56] References Cited

UNITED STATES PATENTS

| | | | |
|---|---|---|---|
| 3,626,898 | 12/1971 | Gawron | 118/637 |
| 3,697,050 | 10/1972 | Stanley | 118/637 X |
| 3,707,947 | 1/1973 | Reichart | 118/637 |
| 3,724,422 | 4/1973 | Latone et al. | 118/637 X |

OTHER PUBLICATIONS

IBM Tech. Disclosure Bulletin, Mag. Brush Devel., by Cross et al, Vol. 9, No. 9, Feb., 1967.

IBM Tech. Disclosure Bulletin, Mag. Brush Unit with Mag. Conveyor, by Freeman et al., Vol. 15, No. 4, Sept., 1972.

*Primary Examiner*—Robert P. Greiner

[57] ABSTRACT

An active crossmixer comprising a pair of rotatably driven augers and a baffle for partially submerging the augers in developer is mounted in the development system of an electrostatic processor above the sump in a position to intercept the developer returning from the development zone and any additional toner added to maintain the toner concentration at a suitable high level. The developer is divided between the augers which, in turn, laterally transport the developer in opposite directions. Preferably, the baffle is apertured so that developer not only flows over the ends of the baffle but also through the baffle, thereby distributing the developer across the full width of the sump.

15 Claims, 11 Drawing Figures

PARTIALLY SUBMERGED ACTIVE CROSSMIXER

BACKGROUND OF THE INVENTION

This invention relates to development systems for electrostatic processors and, more particularly, to crossmixers for such systems.

In a conventional electrostatic printing process of the type described in Carlson's U.S. Pat. No. 2,297,691 on "Electrophotography," a uniformly charged photoreceptor is selectively discharged in an image configuration to provide a latent electrostatic image which is then developed through the application of a finely divided, resinous material, called "toner." As is known, that process has enjoyed outstanding commercial success, especially in plain paper copiers and duplicators. Nevertheless, substantial effort and expense are still being devoted to the perfection of the process, including the development step.

The vehicle normally used in electrostatic processors to deliver the toner is a multi-component developer comprising toner particles and relatively coarse "carrier" particles. The toner and carrier (or sometimes carrier coating) are formed from materials which are removed from each other in the triboelectric series, thereby enabling a triboelectric charging process to be employed to induce electrical charges of opposite polarities on the toner and carrier particles. The polarity of the charge for the toner particles is selected to oppose the charge of the latent image so that there are competing electrostatic forces acting on those particles. Specifically, the toner particles at least initially tend to be attracted to the carrier particles, but are subject to being electrostatically stripped therefrom whenever the developer is brought into the immediate proximity of or actual contact with an image bearing photoconductor.

Provision is commonly made in existing development systems for adding additional toner to the developer from time-to-time so that the toner concentration remains at a suitable high level. Additionally, there are passive and active crossmixers for maintaining a more or less uniform distribution of toner throughout the supply of developer so that the developer may be recirculated numerous times without a marked reduction in the quality of the copies produced.

Active crossmixers are externally powered, rather than being wholly dependent on gravity. Consequently, they have several advantages over passive ones. For example, they tend to be (1) better suited to use in compact development systems, (2) less sensitive to variations in the developer charge and (3) at least potentially more effective in (a) blending the toner and carrier particles, (b) reducing the incidents of toner impaction and (c) promoting the triboelectric charging of the toner and carrier particles. Conventional crossmixers of this type have not, however, met with complete success. The primary reason for that is that the usual practice of forming an active crossmixer by fully submerging one or more rotatably driven augers in the developer sump means that substantial input power is required to drive the crossmixer and also creates the risk that significant amounts of developer will bypass the crossmixers.

SUMMARY OF THE INVENTION

Accordingly, the primary aim of this invention is to provide a relatively efficient active crossmixer for use in development systems of electrostatic processors. In more detail, an object is to provide an active crossmixer which is more efficient than those that are now available, whether measured in terms of the blending and crossmixing achieved per unit of input power or in terms of the percent of recirculated developer which bypasses the crossmixer.

To carry out these and other objects of the invention, an active crossmixer comprising a pair of rotatably driven augers and a baffle for partially submerging the augers in developer is mounted in the development system of an electrostatic processor above the sump in a position to intercept the developer returning from the development zone and any additional toner added to maintain the toner concentration at a suitably high level. The developer is divided between the augers which, in turn, laterally transport the developer in opposite directions. Preferably, the baffle is apertured so that developer not only flows over the ends of the baffle but also through the baffle, thereby distributing the developer across the full width of the sump.

BRIEF DESCRIPTION OF THE DRAWINGS

Other objects and advantages of the invention will become apparent when the following detailed description is read in conjunction with the attached drawings, in which.

Figure 8:
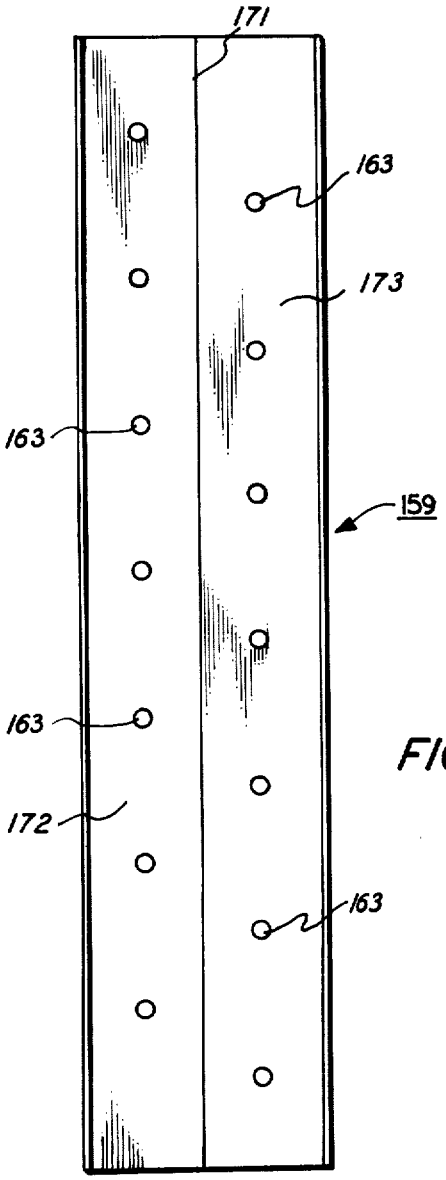
Figure 9:
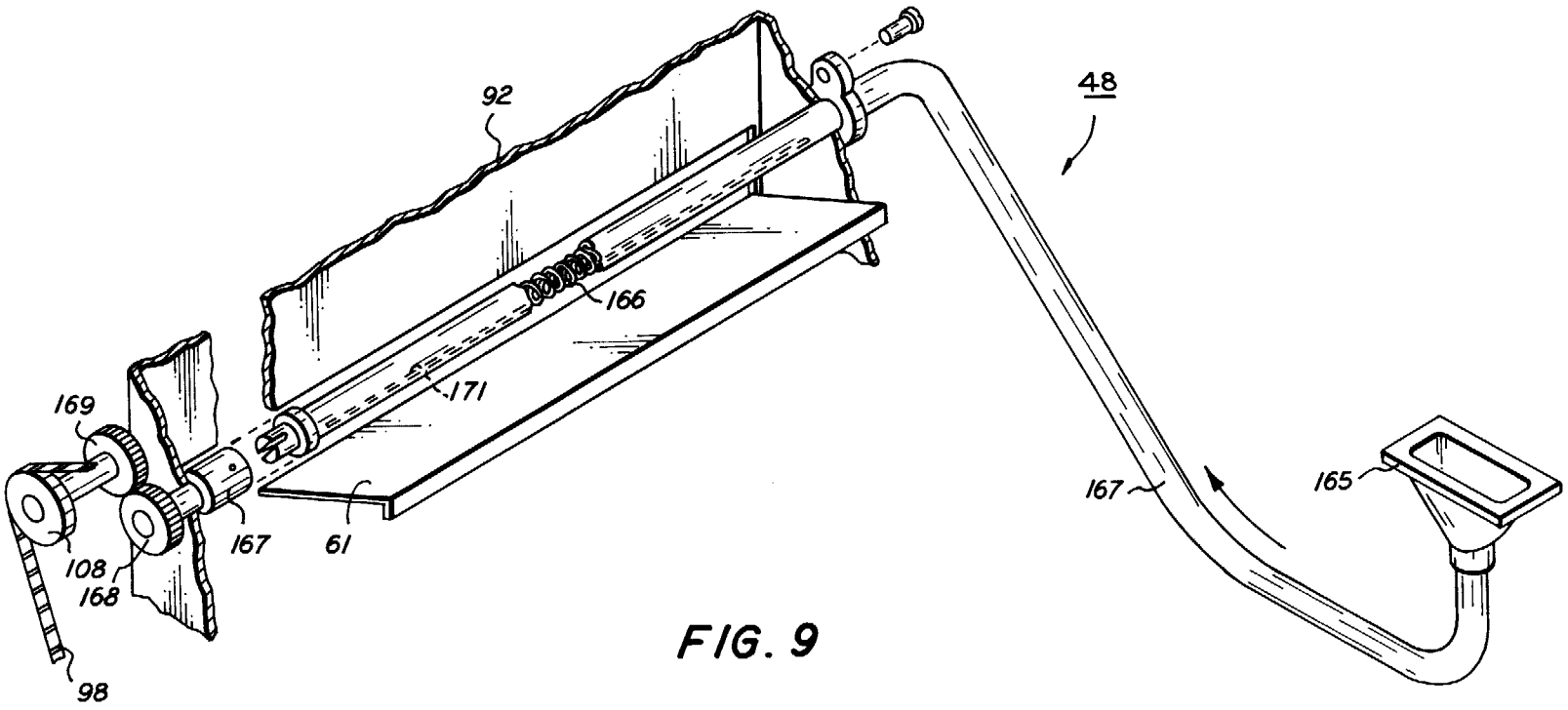

FIGS. *7a* – *7c* are fragmentary views of a failsafe mechanism for releasably latching the sections of the housing together;

FIG. 8 is a top view of the baffle for the partially submerged, auger-type cross-mixer included in the development system; and FIG. 9 is a perspective view with a cut away section illustrating a suitable toner reclaiming system.

DETAILED DESCRIPTION OF THE ILLUSTRATED EMBODIMENT

While the invention is described in some detail hereinafter with reference to a specific embodiment, it is to be understood that there is no desire to limit it to that embodiment. On the contrary, the intent is to cover all modifications, alternatives and equivalents falling within the spirit and scope of the invention as defined by the appended claims.

Figure 1:
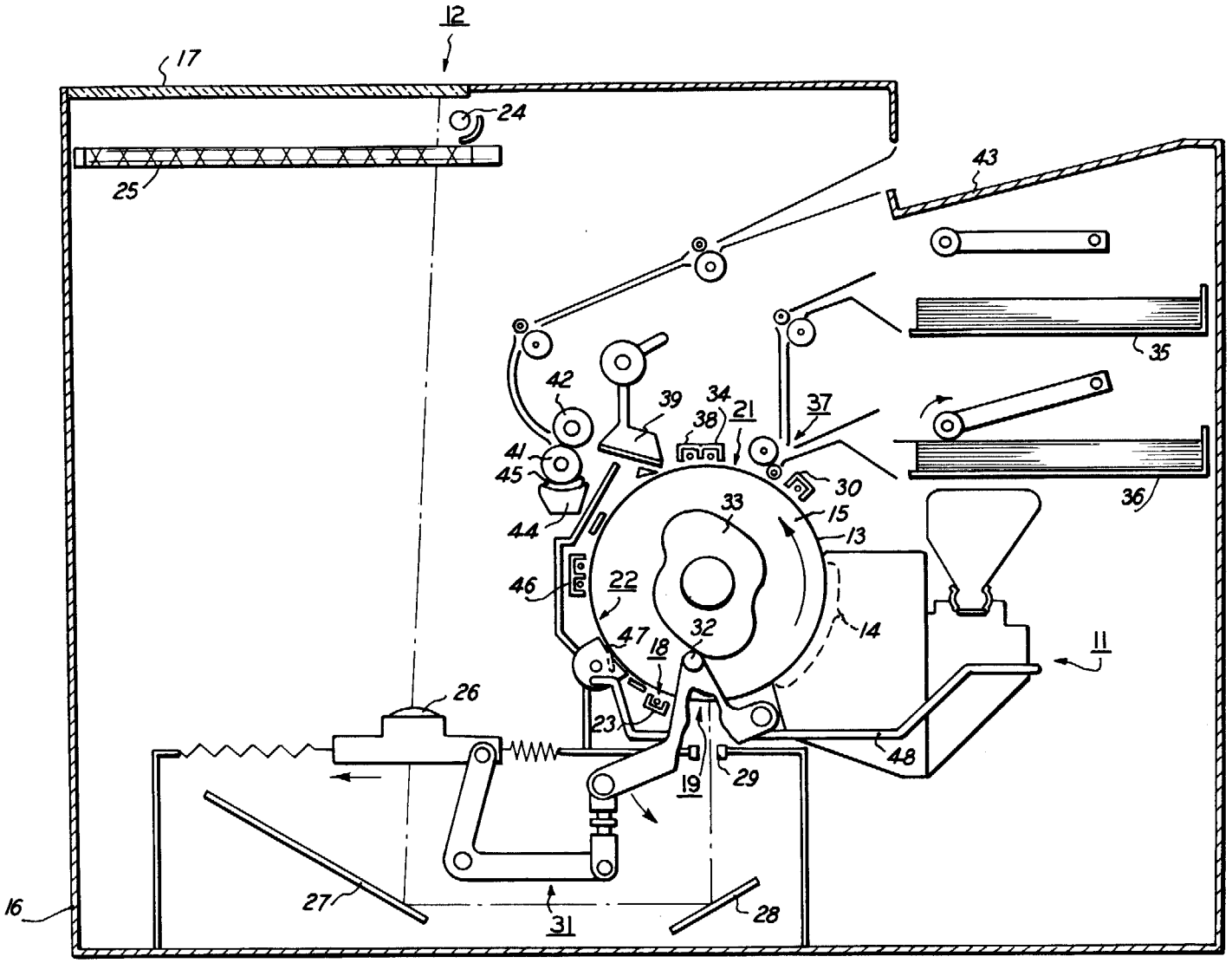
FIG. 1 is a simplified schematic diagram of an electrostatic processor having a development system embodying the present invention.

Turning now to the drawings, and at this point especially to FIG. 1, it will be seen that the invention is embodied in a development system 11 which is used in an electrostatic processor 12 to develop latent electrostatic images carried by a photoconductor 13 on the fly - viz., as the photoconductor 13 moves through a development zone 14. In this instance, the photoconductor 13 is coated on the surface of a rotatable drum 15. It will be apparent, however, that there are other suitable machine configurations, including one wherein a flexible photoconductor is supported by a belt-like substrate.

There is no reason to dwell at length on the processor 12. It is simply an exemplary environment for the invention, and it closely resembles a commercially available "4000" copier of Xerox Corporation as modified to include the new development system 11. Thus, anyone interested in the specific details of that copier can inspect one of the commercially available units and refer to the published literature describing it, such as U.S. Pat. No. 3,724,019, which issued Apr. 3, 1973 in the name of Alan L. Shanly. Nevertheless, a brief functional description may be helpful.

Considering the processor 12 on that level, it will be observed that the drum 15 and its related components are enclosed within a housing 16 which has a transparent platen 17 for supporting a document or other objects (i.e., subject copy) image side down in position to be copied. The drum 15 is rotatably driven in the direction of the arrow (counterclockwise as shown) so that the photoconductor 13 is sequentially advanced during each copying cycle through a charging station 18, an exposure station 19, the development zone 14, a transfer station 21, and a cleaning station 22.

At the outset of each copying cycle, the photoconductor 13 is uniformly charged by a corona generator 23 as it advances through the charging station 18 and then selectively discharged in response to light reflected from the subject copy as it advances through the exposure station 19. There is, therefore, a latent electrostatic image of the subject copy on the photoconductor 13 when it reaches the development zone 14.

To carry out the exposure step, this particular copier comprises a scanning lamp 24 which is driven from one side to the other of the platen 17 during each copying cycle by a double helix auger drive 25 to illuminate successive lines or strips of the subject copy from below. The light reflected from the subject copy, which is intensity modulated in accordance with the image to be copied, is focused on the photoconductor 13 by a movable lens 26, a pair of stationary mirrors 27 and 28, and an exposure slit 29. To maintain the focus, the movable lens 26 is laterally driven in timed synchronism with the scanning lamp 24. That is accomplished by means of a linkage 31 which has a follower 32 riding on a camming surface 33 which, in turn, is mounted for rotation with the drum 15.

As described in detail hereinbelow, the development system 11 applies toner to develop the image carried by the photoconductor 13 as it advances through the development zone 14. The toner charge is then partially neutralized by a pre-transfer corona generator 30, thereby conditioning the toner image for transfer to a copy sheet under the influence of transfer corona generator 34 at the transfer station 21. The copy sheet is selectively fed from one of two supply trays 35 and 36 and is brought into contact with the photoconductor 13 by a sheet feeding and registration mechanism schematically shown at 37.

After the image has been transferred, the drum 15 rotates beneath a detack corona generator 38 which, at least partially neutralizes the charge previously provided by the transfer corona generator 34, and then beneath a vacuum-type stripper 39. The stripper 39 removes the copy sheet from the photoreceptor 13 and transports it into a nip between a pair of heated fuser rolls 41 and 42.

The fuser rolls 41 and 42 supply heat and pressure for fixing the toner image to the copy sheet so that the copy which is ultimately fed into the output tray 43 has a substantial degree of permanence. To minimize the tendency for toner to offset during the fusing process, there is a reservoir 44 with a wick 45 for applying a release agent such as silicone oil, to the lower fuser roll 41, which is the one that engages the image bearing side of the subject copy.

While fusing is taking place, the photoreceptor 13 continues to advance into the cleaning station 22 where there is a pre-cleaning corona generator 46 for at least partially neutralizing the charge tending to hold residual toner on the photoconductor 13 followed by a resilient cleaning blade 47 for wiping the residual tones from the photoconductor 13 in preparation for the next copying cycle. The toner reclaimed at the cleaning station 22 is returned to the development system 11 through a toner transport mechanism 48.

Figure 2:
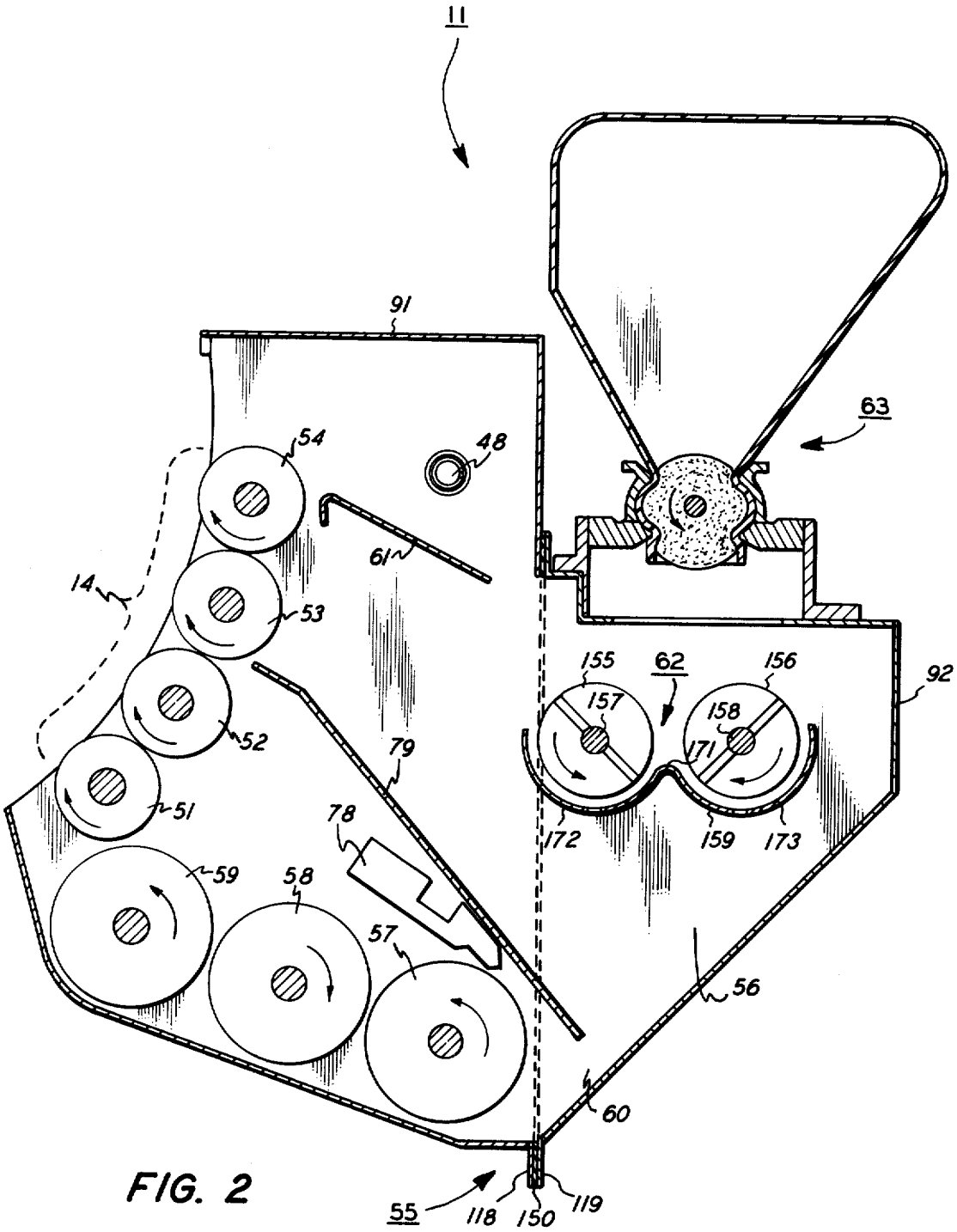
FIG. 2 is a sectional view illustrating the basic components of the development system.
Figure 3:
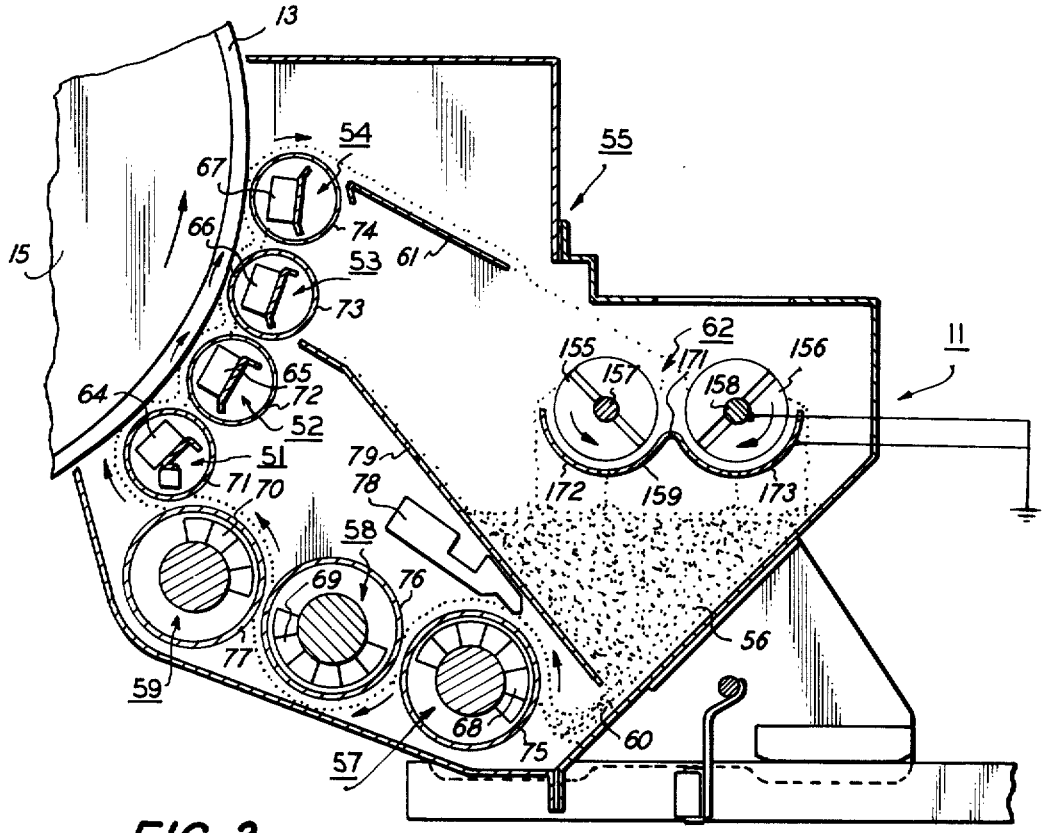
FIG. 3 is another sectional view illustrating further features of the development system.

As shown in FIGS. 2 and 3, the development system 11 is a so-called "magnetic brush" unit having a series of four development rolls 51–54 positioned in parallel spaced apart relationship along the length of the development zone 14 for bringing developer into contact with the photoconductor 13. The development rolls 51–54 are mounted in a housing 55 which comprises a sump 56 for storing a supply of developer, a series of three magnetic transport rolls 57–59 for transporting developer from the sump 56 to the first or lowermost development roll 51, and a slide 61 for guiding developer from the last or uppermost development roll 54 to a crossmixer 62. As explained more fully hereinbelow, the crossmixer 62 conditions the incoming developer for recirculation and then returns it to the sump 56. Some toner is, of course, removed from the developer each time an image is developed. Thus, there is a toner dispenser 63 mounted on the housing 55 in a position directly above the crossmixer 62 for adding fresh toner to the developer from time-to-time so that its toner concentration remains at a suitably high level.

This type of development system is conventionally supplied with a multi-component developer comprising finely divided, resinous toner particles and relatively coarse, ferromagnetic carrier particles. The materials for the toner and carrier (or sometimes carrier coating) are removed from one another in the triboelectric series so that a triboelectric charging process may be relied upon to induce electrical charges of opposite polarities on the toner and carrier particles. Moreover, the materials are selected so that the charge imparted to the toner particles opposes the charge of the latent images which are to be developed. Therefore, in operation, there are competing electrostatic forces acting on the toner particles, whereby those particles are at least initially attracted to the carrier particles, but are subject to being electrostatically stripped therefrom whenever the developer is brought into the immediate proximity of or actual contact with the photoconductor 13.

As best shown in FIG. 3, developer flowing through an opening 60 near the bottom of the sump 56 is transported along a generally S-shaped path by the transport rolls 57–59 and is then fed upwardly between the photoconductor 13 and successive ones of the development rolls 51–54. The developer within this part of the system is magnetically constrained. Specifically, the development rolls 51–54 and the transport rolls 57–60 comprise permanent magnet assemblies 64–70, respectively, which are supported within separate non-magnetic, cylinderical sleeves 71–77 to provide stationary magnetic fields. Those fields entrain the developer on the sleeves 71–77 which, in turn, are rotatably driven in the direction indicated by the arrows so that the developer advances from roll-to-roll as previously described.

Characteristically, the fields provided by the magnetic assemblies 64–67 of the development rolls 51–54 are shaped so that the developer tends to collimate as it passes between those rolls and the photoconductor 13, thereby forming bristle-like stacks of developer which brush against the photoconductor 13. To ensure that the "magnetic brushes" thus formed have a more or less uniform profile across the width of the development zone 14, there is in this instance a timmer bar 78 secured to the outer surface of the forward sidewall 79 of the sump 56 for leveling the developer magnetically entrained on the first transport roll 57.

Figure 4:
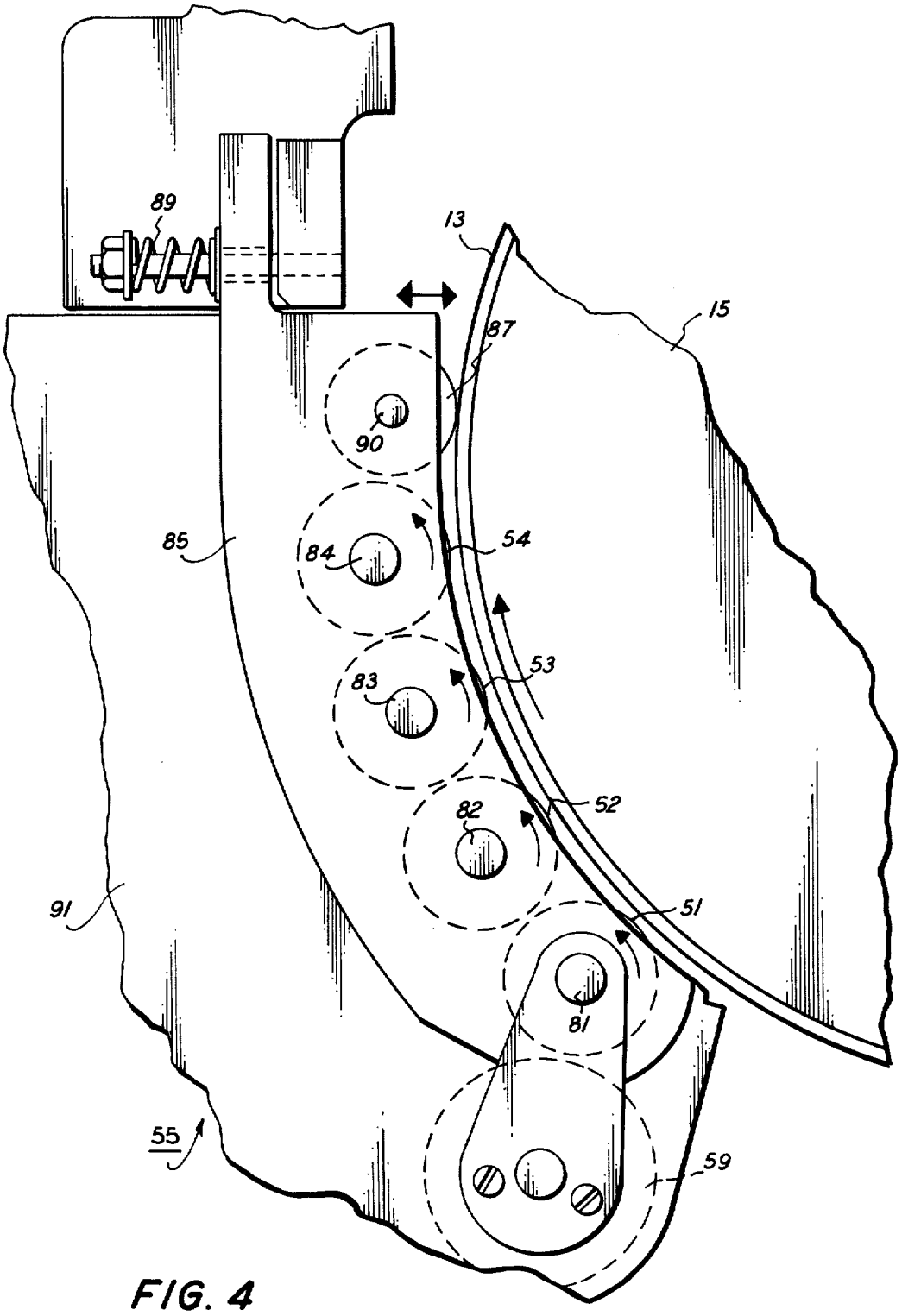
FIG. 4 is a fragmentary elevational view showing the provision made in the development system to compensate for run-out variations in the drum of the processor.

Referring to FIG. 4, one of the important features of the development system 11 is that provision is made to compensate for variations in the radial run-out of the drum 15. It has been found that variations of that type tend to be distributed circumferentially about the drum 15 and are sometimes of sufficient magnitude to adversely affect the development process. In recognition of that, means are provided for automatically moving at least the last or uppermost development roll 54 toward and away from the axis of the drum 15 in response to the run-out variations, thereby maintaining a substantially constant spacing or gap between that roll and the photoconductor 13. As will be appreciated, the uppermost development roll 54 is the most ciritical one because it has the last pass at any latent image carried by the photoconductor 13.

More particularly, to compensate for the variations in the drum run-out, the opposite ends of the shafts 81–84 of the development rolls 51–54, respectively, are supported in journals by a pair of brackets 85 and 86 which are, in turn, pivotally mounted for rotation about the axis of the first or lowermost development roll 51. Followers 87 and 88 (see also FIGS. 5 and 6) are mounted on the brackets 85 and 86, respectively, adjacent the uppermost development roll 54, and the brackets 85 and 86 are biased toward the drum 15 by separate bias srings 89 (only one can be seen) so that the followers 87 and 88 ride, say, on the surface of the drum 15 outboard of the photoconductive surface 13. Consequently, the brackets 85 and 86 pivot to move the development rolls 52–54 toward and away from the drum 15 in response to variations in the radial run-out of the drum 15. Accordingly, it will be understood that this provision not only maintains a substantially constant spacing between the uppermost development roll 54 and the photoconductor 13, but also tends to reduce the variations in the spacing between the intermediate development rolls 52 and 53 and the photoconductor 13.

Preferably, the followers 87 and 88 are disc-like and free to rotate so that they apply little, if any, drag to the drum 15. As shown, a rod 90 may be connected between the followers 87 and 88 to stiffen the housing 55.

Figure 5:
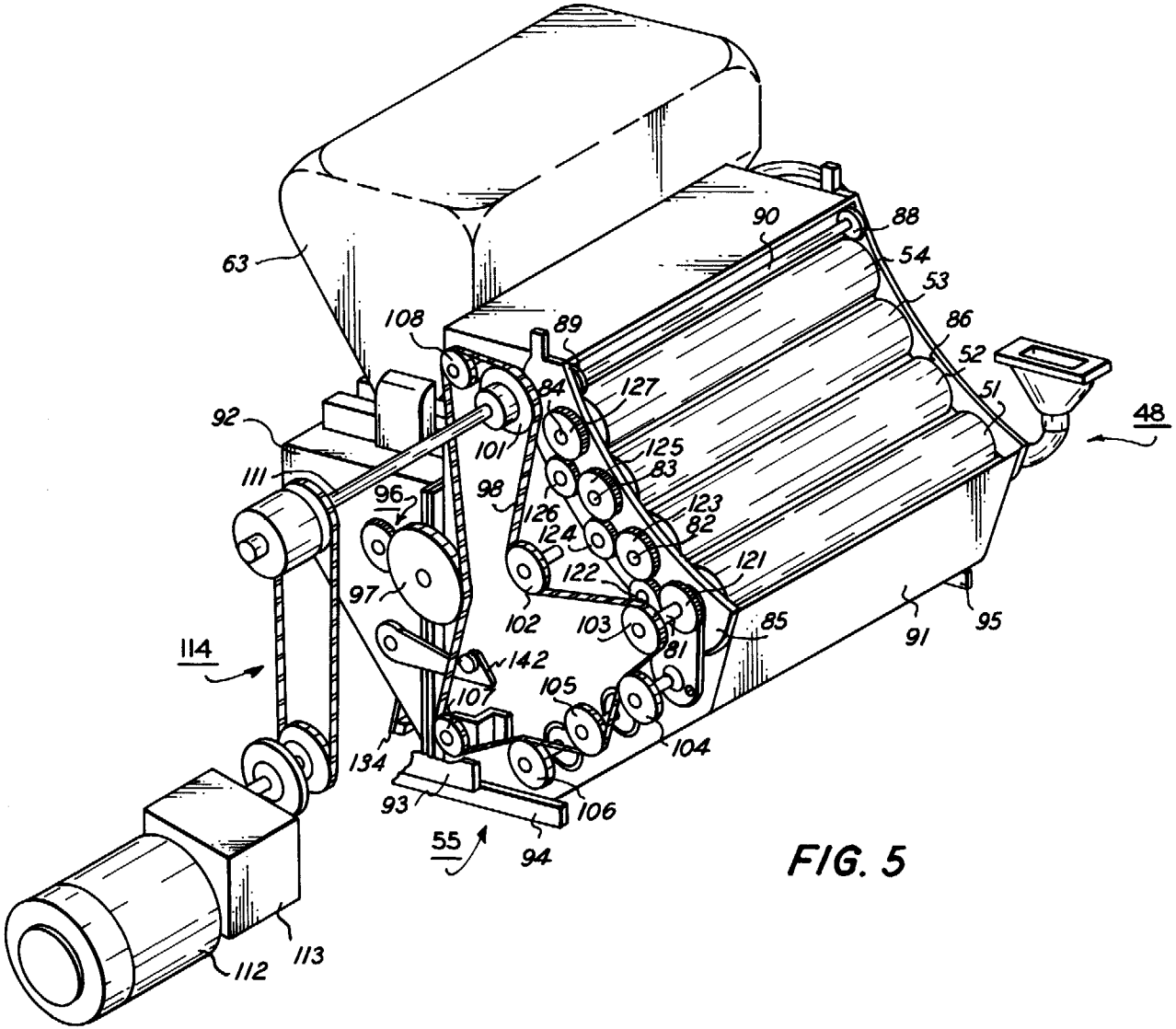
FIG. 5 is an isometric view illustrating the split housing provided for the development system in its closed or operational state.
Figure 6:
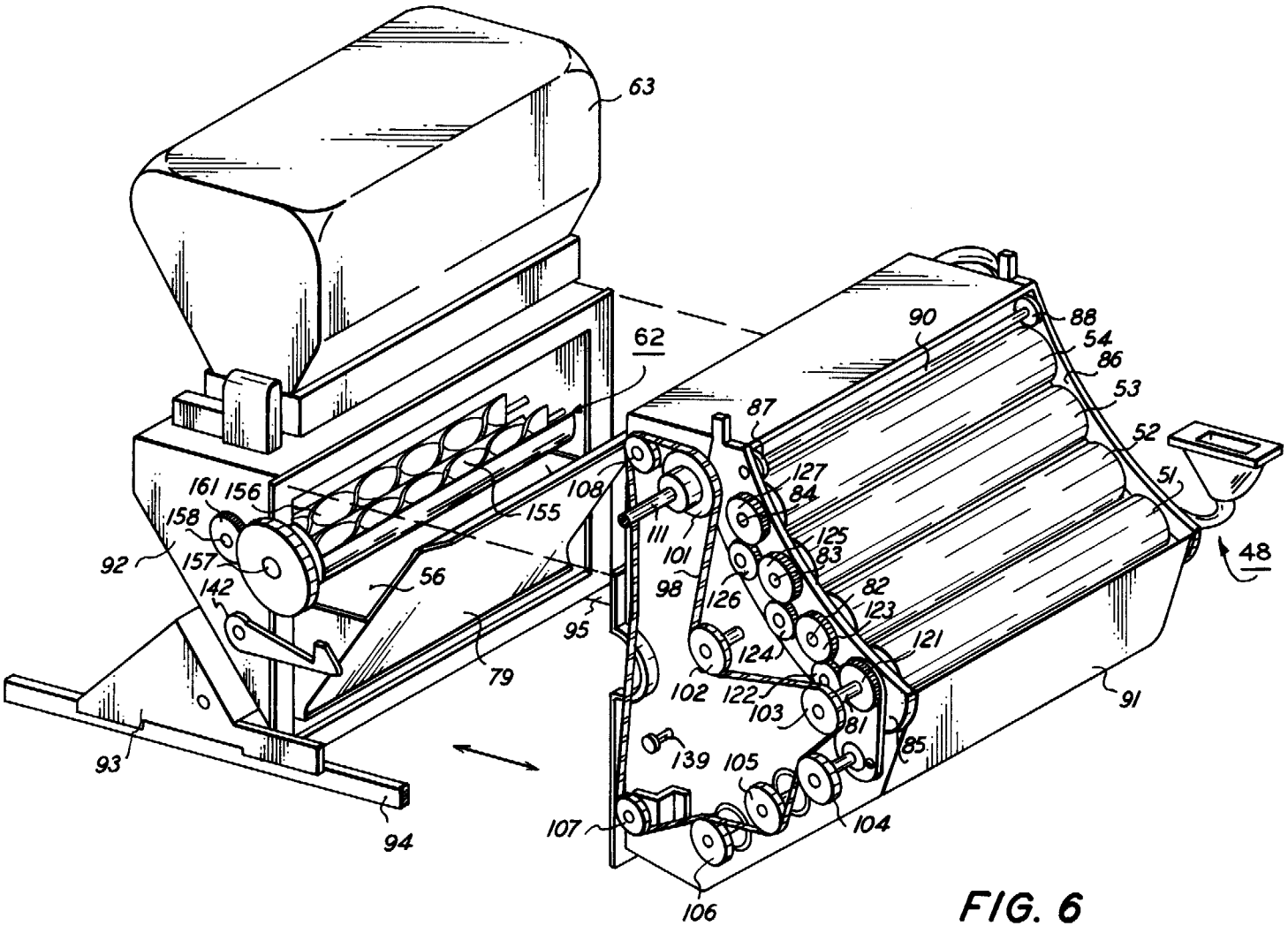
FIG. 6 is another isometric view showing the split housing in its open or non-operational state.

Turning next to FIGS. 5 and 6, another important feature of the development system 11 is that the housing 55 is "split" so that most of the maintenance which may be called for from time-to-time to keep the system in a fully operational state can be carried out without moving its position sensitive components, such as the development rolls 51–54. To accomplish that, as shown, the housing 55 comprises a stationary section 91 for the development rolls 51–54, the transport rolls 57–59 and the slide 61, together with a movable section 92 for the sump 56, the cross-mixer 62 and the toner dispenser 63. The movable section 92 is supported by suitable bearing blocks 93 (only one can be seen) on a pair of generally horizontal, parallel rails 94 and 95 which extend substantially perpendicularly from the axis of the drum 15. Consequently, when maintenance is required, the movable section 92 of the housing 55 is slid back from the stationary section 91, thereby providing access to most any area requiring attention. It follows, therefore, that the time consuming task of resetting the nominal spacings between the development rolls 51–54, on the one hand, and the photoconductor 13, on the other, is an exceptional maintenance procedure, rather than a normal one.

To further simplify the maintenance procedures, an indirect drive 96 is provided for the movable section 92 of the developer housing 55. To that end, in the illustrated embodiment, power is transferred to that section through a sprocket wheel 97 which engages with and disengages from a drive belt 98 as the movable section 92 of the housing 55 is moved toward and away from the stationary section 91. The drive belt 98 is trained around a series of sprocket wheels 101–108 which are carried by the stationary section 92, and the sprocket wheel 101 is pinned to a drive shaft 111 which, in turn, is coupled to a motor 112 by a gear reduction box 113 and a belt and pulley mechanism 114.

In the interest of completeness, it is appropriate to note at this point that the first or lowermost development roll 51 and the transport rolls 57–59 are directly driven by the sprocket wheels 103–106, respectively. The other development rolls 52–54 are, however, indirectly driven off the sprocket wheel 103 by a gear train 121–127 so that the bracket 85 is free to pivot in response to variations in the radial run-out of the drums 15, without affecting the tension on the drive belt 98.

Referring now to FIGS. *7a–7c*, still another noteworthy aspect of the development system 11 is that the two sections 91 and 92 of the housing 55 are releasably latched by a catch mechanism 131 which is interlocked with a flow gate 132 so that the housing 55 can be "split" only after the gate 132 has been closed to interrupt the flow of developer from the sump 56. This precaution is taken because any significant risk of developer being accidentally spilled or otherwise discharged from the housing 55 would weigh heavily against its use, despite all of its advantages.

As illustrated, the flow gate 132 is similar to the "Developer Shut-Off Apparatus" described and claimed in a copending and commonly assigned United States patent application of Richard E. Smith, which was filed Apr. 29, 1974 under Ser. No. 464,862. That is, it includes a rotatable shaft 133 which is journalled in the movable section 92 of the housing 55 to swing a permanent magnet 134 mounted on the lower end of a bracket 135 toward and away from the sump 56 under the control of a manually operable lever arm 136. A straightforward linkage suffices. Here, for example, the lower end of the lever arm 136 is pinned to the shaft 133 which, in turn, is attached by a weld or the like to the upper end of the bracket 135.

Figure 7A:
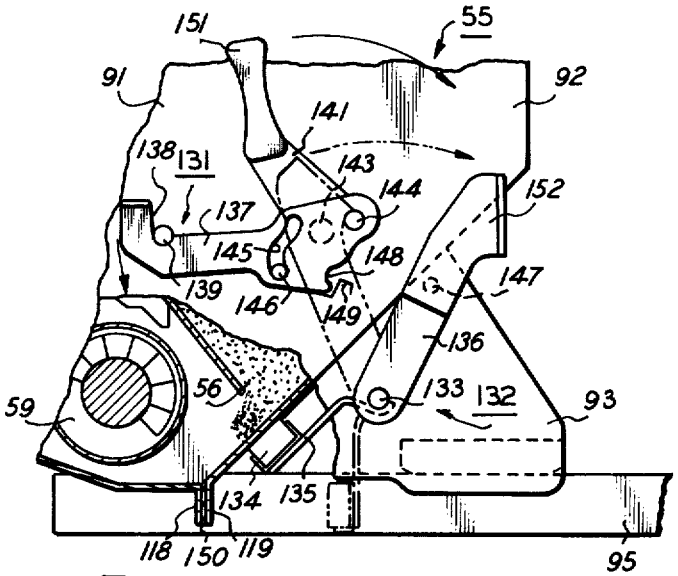

To permit the flow of developer to be selectively turned "on" and "off," the magnet 134 extends across substantially the full width of the sump 56 and is poled to attract the ferromagnetic carrier component of the developer. Additionally, the strength of the magnet 134 and the length of the bracket 135 are selected so that the influence on the developer of the magnetic field supplied by the magnet 134 varies between a fully controlling level and a negligible level as a function of the position of the lever arm 136. Specifically, as best shown in FIG. 7*a*, the field is fully controlling when the lever arm 136 is advanced to, say, a clockwise limit because the magnet 134 then abuts the sump 56 at approximately the level of the discharge opening 60 (the solid line position). That causes the developer to bridge the opening 60, thereby interrupting the flow of developer. Contraiwise, when the lever arm 136 is moved to its other or counterclockwise extreme (its phantom line position), the magnet 134 is sufficiently remote from the sump 56 to insure that its field has little, if any, effect on the flow of developer. Of course, the attractive force between the magnet 134 and the ferromagnetic component of of the developer increases as the magnet 134 approaches the sump 56 so that there is a bias which is effective even before the magnet 134 reaches the sump 56 to urge the magnet 134 theretoward. That bias must, therefore, be overcome whenever it is desired to restore the system to an operational state.

Figure 7B:
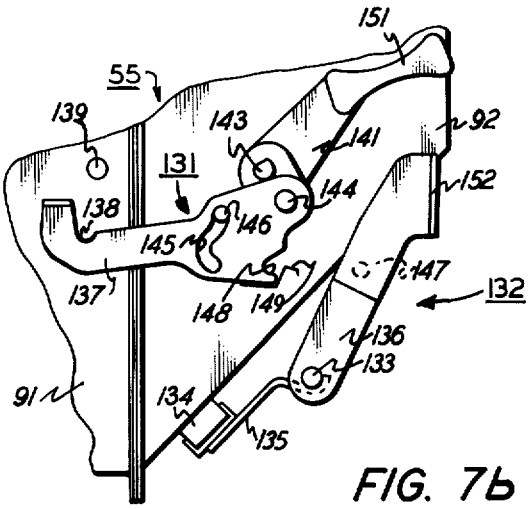
Figure 7C:
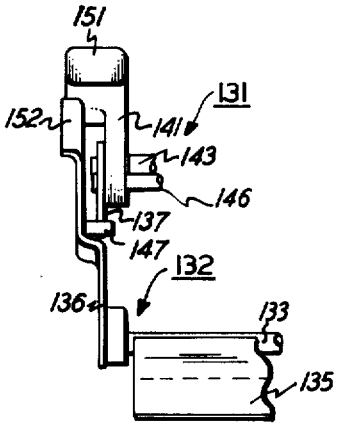

The catch mechanism 131, on the other hand, comprises a link 137 with a hook 138 at its outer end which is selectively engaged with and disengaged from a pin 139 under the control of another manually operable lever arm 141 to latch and de-latch, respectively, the two sections 91 and 92 of the housing 55. There desirably is a second catch 142 on the opposite side of the housing 55 (FIGS. 5 and 6). However, the one shown in FIGS. 7*a*–7*c* is not only representative, but also provides a basis for describing the aforementioned interlock.

Concentrating, therefore, on the catch 131, it will be seen that the pin 139 is anchored on the stationary section 91 of the housing 55 and that the link 137 is secured to the other or movable section 92 by means of a fixed pivot 143 for the lever arm 141. The lever arm 141 rotates on the pivot 143, but the link 137 preferably follows a reasonably rectilinear path to reduce the risk of mechanical jams occurring during the latching and delatching processes. For that reason, the link 137 is connected to the lever arm 141 by a floating pivot 144 and includes a slotted cam track 145 which rides on a peg 146 fastened to movable section 92 of the housing 55. The relative locations for the fixed pivot 143 and the floating pivot 144 are chosen so that the cam track 145 tends to travel upwardly and downwardly on the peg 146 in response to counterclockwise rotation and clockwise rotation, respectively of the lever arm 141. Further, the link 137 is sequentially urged in a generally horizontal direction and a generally vertical direction. For example, to carry out the de-latching process, the lever arm 141 is rotated in a clockwise direction, thereby moving the link 137 first forwardly to release the hook 138 from the pin 139 and then downwardly to provide a vertical clearance between the link 137 and the pin 139 (FIG. 7*b*). Conversely, to carry out the latching process, the lever arm 141 is rotated in a counterclockwise direction, thereby moving the link 137 initially upwardly and then rearwardly to seat the hook 138 on the pin 139 (FIG. 7*a*). In passing, it should be noted that there are mating flanges 118 and 119 on the stationary and movable sections 91 and 92, respectively, of the housing 55 and that at least one of those flanges carries a gasket 150 or the like which provides a seal between the two sections 91 and 92 of the housing 55 when the catches 131 and 142 are engaged.

Indeed, one of the special advantages of the provision made to prevent the catch 131 from being released while the flow gate 132 is open is that the flow gate 132 may be opened and closed at will while the catch 131 is engaged. As a practical matter, that means that the stationary section 91 of the housing 55 may be purged of developer, without compromising the aforementioned seal, simply by closing the flow gate 132 to interrupt the flow of developer from the sump 56 and thereafter operating the system for a short period of time sufficient to enable the developer previously admitted to the stationary section 91 to return to the movable section 92 via the transport rolls 57–59, the development rolls 51–54 and the slide 61 (FIG. 3).

Specifically, in the illustrated embodiment, there are two more or less independent interlocks for thwarting any attempt to release the catch 131 while the flow gate 132 is still open. First, there is a lug 147 projecting rearwardly from the lever arm 136, together with a complementary notch 148 on the inner shoulder of the link 137. When the catch 131 is engaged and the flow gate 132 is open, the lug 147 seats in the notch 148, suitably with the assistance of a retaining spring 149. Under those circumstances, the catch 131 cannot be disengaged inasmuch as the notch 148 is spaced from the pivot 144. Should the primary interlock fail for one reason or another, there still is a secondary interlock to prevent the catch 131 from being prematurely released. Here, the back-up protection is afforded by providing the lever arms 141 and 136 of the catch 131 and flow gate 132, respectively, with separate handles 151 and 152 which are configured so that the latter interferes with the movement of the former in the event of any attempt to release the catch 131 while the flow gate 132 is still open.

Referring now to FIGS. 2, 3, 6 and 8, yet another significant feature of the development system 11 is that the crossmixer 62 is a partially submerged, active crossmixing device which is mounted above the sump 56 in position to intercept not only the developer returning from the development zone 14 via the slide 61, but also any additional toner supplied by the toner dispenser 63. Among the reasons that the crossmixer 62 is especially noteworthy are that it requires relatively little power but still provides effective crossmixing and blending by virtue of being only partially submerged in a continuously changing, locally confined supply of developer. The temporary, local confinement of the developer is a particularly important concept because it reduces the risk of developer by passing the crossmixing process.

More particularly, as shown, the crossmixer 62 comprises a pair of screw augers 155 and 156 which are supported on generally parallel, rotatably mounted shafts 157 and 158, respectively, above a baffle 159 which has a central flow splitting region 171 disposed between a pair of generally U-shaped channels 172 and 173. The augers 155 and 156 and the baffle 159 extend across substantially the full width of the movable section 92 of the housing 55, but are slightly spaced from the sides thereof. The channels 172 and 173 of the baffle 159 partially cup the augers 155 and 156, respectively, but are spaced a short distance therefrom. The flow splitting region 171 of the baffle 159 is, in turn, vertically aligned with the toner dispenser 63 and roughly in the middle of the flow path for developer from the slide 61 so that it divides the developer and fresh toner more or less evenly between the channels 172 and 173. Preferably, there are several small apertures 163 passing through the channels 172 and 173 at spaced apart points along the length thereof to aid in maintaining a more or less even level of developer within the sump 56.

In operation, the augers 155 and 156 are rotated to laterally translate the developer toner loads of the channels 172 and 173 in opposite directions. Here, the augers 155 and 156 have the same hand (e.g., both right-hand devices) and are, therefore, counter-rotated by means of a pair of meshed gears 161 (only one can be seen in FIG. 6) which are coupled to the sprocket wheel 97. The same result could, however, be achieved by rotating them in the same direction if one happened to have a right-hand lead and the other a left-hand lead. In either event, the developer toner entering one or the other of the channels 172 and 173 dwells therein under the direct influence of the auger 155 or 156 until it finds its way out through one of the apertures 163 or over the outboard edges of the baffle 159. In practice, of course, the incoming and outgoing flows to and from the crossmixer 62 tend to balance.

Turning now to FIG. 9 for the details of an exemplary toner reclaiming system 48, it will be seen that it includes an elongated, rotatably driven, helical spring 166 which is encased in a flexible jacket 167 to transport toner from a funnel-like pick-up chute 165 to an elongated discharge port 171. The pick-up chute 165 is mounted (by means not shown) to accept toner recovered at the cleaning station 22 (FIG. 1), and the discharge port 171 is positioned to dump the recovered toner onto the slide 61 in the stationary section 91 of the developer housing 55. Preferably, the spring 166 is driven from the downstream end so that it tends to expand or "windup" when subjected to a load. For that reason, the drive for the developer housing 55 comprises a coupling 167 and a pair of meshed gears 168 and 169 for driving the spring 166 with the sprocket wheel 108.

The augers or baffle may, if desired, be made of a conductive material and electrically grounded whereby excessive charge is drained from the carrier particles while the developer is being mixed and blended. In addition, the augers or baffle may be coated with a material selected to augment the triboelectric charging of the toner particles or with a release agent selected to inhibit toner from adhering thereto. Furthermore, the augers or baffle may have a roughened surface finish whereby developer is mechanically abraded while being mixed and blended, thereby inhibiting said toner particles from mechanically impacting on the carrier particles.

CONCLUSION

In view of the foregoing, it will now be appreciated that a development system with several advantageous features has been described. Accordingly, it should be understood that the feature of principal concern here is the crossmixer. The split housing is the subject of a copending, concurrently filed application of Richard E. Smith and John E. Forward, Ser. No. 525,530; and the roll mounting is the subject of another copending, concurrently filed application of John E. Forward, Ser. No. 525,529.

What is claimed is:

1. In a development system for developing latent electrostatic images carried by a substrate through the use of a developer containing triboelectrically charged toner and carrier particles; said system including a sump for storing a first supply of developer, and means for circulating developer along a predetermined path running from said sump, across said substrate and then back to said sump; the improvement comprising an active crossmixer positioned in said path above said sump for mixing and blending developer returning to said sump; said crossmixer including a baffle positioned in said path remote from said sump to provide a second continuously changing, locally confined supply of developer in addition to said first supply, and a rotatably driven auger mounted above said baffle and partially submerged in said second supply said auger being partially cupped by said baffle for laterally translating said locally confined supply of developer.

2. The improved development system of claim 1 further including a toner dispenser mounted above said crossmixer for adding additional toner to said developer from time-to-time.

3. The improved development system of claim 1 wherein at least one of said augers and baffle is an electrically conductive grounded member, whereby excessive charge is drained from said carrier particles while said developer is being mixed and blended.

4. The improved development system of claim 1 wherein at least one of said auger and baffle is coated with a material selected to augment the triboelectric charging of said toner particles.

5. The improved development system of claim 1 wherein at least one of said auger and baffle is coated with a release agent selected to inhibit toner from adhering thereto.

6. The improved development system of claim 1 wherein at least one of said auger and baffle has a roughened surface finish, whereby said developer is mechanically abraded while being mixed and blended, thereby inhibiting said toner particles from mechanically impacting on said carrier particles.

7. In a development system for developing latent electrostatic images carried by a substrate through the use of a developer containing triboelectrically charged toner and carrier particles; said system including a sump for storing a supply of developer, and means for circulating developer along a predetermined path running from said sump, across said substrate and then back to said sump; the improvement comprising a partially submerged active crossmixer positioned in said path above said sump for mixing and blending developer returning to said sump; said crossmixer including a pair of augers, and a baffle mounted below said augers; said baffle having separate channels partially cupping respective ones of said augers and a central flow splitting region for dividing the developer returning to said sump between said channels; said crossmixer further including means for rotatably driving said augers, whereby the developer in one of said channels is laterally translated in one direction and the developer in the other of said channels is laterally translated in the opposite direction.

8. The improved development system of claim 7 wherein said baffle is apertured at spaced apart intervals along said channels to assist in maintaining a generally uniform level of developer in said sump.

9. The improved development system of claim 7 further including a toner dispenser mounted above said crossmixer in vertical alignment with the flow splitting region of said baffle for adding additional toner to said developer from time-to-time.

10. The improved development system of claim 9 wherein said baffle is apertured at spaced apart intervals along said channels to assist in maintaining a generally uniform level of developer in said sump.

11. The improved development system of claim 9 wherein said augers have the same hand and are counter-rotated to laterally translate the developer in said channels in opposite directions.

12. In a development system for developing latent electrostatic images carried by a substrate through the use of a developer containing triboelectrically charged toner and carrier particles; said system including a sump for storing a first volume of developer, and means for circulating developer along a predetermined path running from said sump, across said substrate and then back to said sump; the improvement comprising an active crossmixer positioned in said path intermediate said substrate and said sump, said crossmixer comprising retaining means for forming a second volume of said developer remote from said volume, said retaining means including entrance and exit openings for concurrently permitting entry of and exit of developer therefrom, and rotatably driven mixer means partially submerged in said second volume for translating developer along said retaining means toward said exit openings.

13. The combination recited in claim 12 further including a dispenser located above said crossmixer for adding toner to said second volume.

14. The combination recited in claim 13 wherein said retaining means comprises a baffle positioned below said mixer means and partially cupping said mixer means.

15. The combination recited in claim 14 wherein said mixer means comprises two rotatably driven augers and said baffle includes two arcuate sections, each partially cupping one of said augers.

* * * * *